US008695625B2

(12) United States Patent
Marty et al.

(10) Patent No.: US 8,695,625 B2
(45) Date of Patent: Apr. 15, 2014

(54) CENTERSET FAUCET WITH MOUNTABLE SPOUT

(75) Inventors: Garry R. Marty, Fishers, IN (US); Kurt J. Thomas, Indianapolis, IN (US); Brian A. Enlow, Fishers, IN (US); Brian Wayne Johnson, Muncie, IN (US); Matthew Lee Kemp, Indianapolis, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 488 days.

(21) Appl. No.: 12/995,402

(22) PCT Filed: Jun. 25, 2009

(86) PCT No.: PCT/US2009/048657

§ 371 (c)(1),
(2), (4) Date: Nov. 30, 2010

(87) PCT Pub. No.: WO2009/158497

PCT Pub. Date: Dec. 30, 2009

(65) Prior Publication Data

US 2011/0079307 A1 Apr. 7, 2011

Related U.S. Application Data

(60) Provisional application No. 61/133,030, filed on Jun. 25, 2008.

(51) Int. Cl.
*F16K 21/00* (2006.01)

(52) U.S. Cl.
USPC ..... 137/315.12; 137/801

(58) Field of Classification Search
USPC ..... 137/315.11, 315.12, 801, 602
See application file for complete search history.

(56) References Cited

U.S. PATENT DOCUMENTS

| | | | |
|---|---|---|---|
| 2,200,091 | A | 5/1940 | Kovach |
| 2,219,471 | A | 10/1940 | Davis |
| 2,546,327 | A | 3/1951 | Young |
| 2,548,933 | A | 4/1951 | Barnett |
| 2,781,786 | A | 2/1957 | Young |
| 2,884,007 | A | 4/1959 | Green |
| 3,229,710 | A | 1/1966 | Keller, III |
| 3,422,849 | A | 1/1969 | Manoogian |

(Continued)

FOREIGN PATENT DOCUMENTS

| | | |
|---|---|---|
| DE | 10133041 | 1/2003 |
| EP | 0 632 220 | 1/1995 |

(Continued)

OTHER PUBLICATIONS

Dadex Polydex—PPR Pipe System for Hot and Cold Water Supply and Distribution, 2005, 2 pgs.

(Continued)

*Primary Examiner* — Kevin Lee
(74) *Attorney, Agent, or Firm* — Faegre Baker Daniels LLP

(57) ABSTRACT

A faucet assembly 10 including base 28 configured to be supported by a sink deck 12, a waterway 22 supported by the base 28, and a valve cartridge 18, 20 fluidly coupled to the waterway 112 way 22. A delivery spout 26 is illustratively supported by the base 28 and receives an outlet conduit 46 in fluid communication with the waterway 22.

25 Claims, 10 Drawing Sheets

(56) References Cited

U.S. PATENT DOCUMENTS

| | | | |
|---|---|---|---|
| 3,448,768 | A | 6/1969 | Keller |
| 3,505,098 | A | 4/1970 | Miller et al. |
| 3,520,325 | A | 7/1970 | Stuart |
| 3,580,289 | A | 5/1971 | James et al. |
| 3,590,876 | A | 7/1971 | Young |
| 3,600,723 | A | 8/1971 | Mongerson et al. |
| 3,635,405 | A | 1/1972 | Shames et al. |
| 3,714,958 | A | 2/1973 | Johnson et al. |
| 3,736,959 | A | 6/1973 | Parkison |
| 3,757,824 | A | 9/1973 | Parkhurst et al. |
| 3,770,004 | A | 11/1973 | Johnson et al. |
| 3,788,601 | A | 1/1974 | Schmitt |
| 3,796,380 | A | 3/1974 | Johnson et al. |
| 3,807,453 | A | 4/1974 | Dom et al. |
| 3,810,602 | A | 5/1974 | Parkinson |
| 3,834,416 | A | 9/1974 | Parkison |
| 3,854,493 | A | 12/1974 | Farrell |
| 3,960,016 | A | 6/1976 | Symmons |
| 3,965,936 | A | 6/1976 | Lyon |
| 3,989,787 | A | 11/1976 | Scott, Jr. et al. |
| 3,998,240 | A | 12/1976 | Liautaud |
| 4,026,328 | A | 5/1977 | Nelson |
| 4,058,289 | A | 11/1977 | Hicks |
| 4,076,279 | A | 2/1978 | Klotz et al. |
| 4,103,709 | A | 8/1978 | Fischer |
| 4,130,136 | A | 12/1978 | Garnier et al. |
| 4,221,338 | A | 9/1980 | Shames et al. |
| 4,316,870 | A | 2/1982 | Rowley |
| 4,337,795 | A | 7/1982 | Argyris et al. |
| 4,356,574 | A | 11/1982 | Johnson |
| 4,357,957 | A | 11/1982 | Bisonaya et al. |
| 4,387,738 | A | 6/1983 | Bisonaya et al. |
| 4,397,330 | A | 8/1983 | Hayman |
| 4,415,389 | A | 11/1983 | Medford et al. |
| 4,446,084 | A | 5/1984 | Rowley |
| 4,453,567 | A | 6/1984 | MacDonald |
| 4,458,839 | A | 7/1984 | MacDonald |
| 4,465,259 | A | 8/1984 | Allen et al. |
| 4,484,600 | A | 11/1984 | Peterson et al. |
| 4,502,507 | A | 3/1985 | Hayman |
| 4,513,769 | A | 4/1985 | Purcell |
| 4,525,136 | A | 6/1985 | Rowley |
| 4,552,171 | A | 11/1985 | Farrell et al. |
| 4,577,835 | A | 3/1986 | Holycross et al. |
| 4,580,601 | A | 4/1986 | Schlotman et al. |
| 4,592,388 | A | 6/1986 | Wilcox |
| 4,604,202 | A | 8/1986 | Movshovitz |
| 4,607,659 | A | 8/1986 | Cole |
| 4,610,429 | A | 9/1986 | Arnold et al. |
| 4,626,005 | A | 12/1986 | Stifter |
| 4,635,673 | A | 1/1987 | Gerdes |
| 4,649,958 | A | 3/1987 | Purcell |
| 4,651,770 | A | 3/1987 | Denham et al. |
| 4,652,263 | A | 3/1987 | Herweck et al. |
| 4,664,423 | A | 5/1987 | Rowley |
| 4,667,987 | A | 5/1987 | Knebel |
| 4,671,316 | A | 6/1987 | Botnick |
| 4,687,025 | A | 8/1987 | Kahle et al. |
| 4,700,928 | A | 10/1987 | Marty |
| 4,708,172 | A | 11/1987 | Riis |
| 4,749,003 | A | 6/1988 | Leason |
| 4,754,783 | A | 7/1988 | Knapp |
| 4,754,993 | A | 7/1988 | Kraynick |
| 4,760,871 | A | 8/1988 | Vijay |
| 4,762,143 | A | 8/1988 | Botnick |
| 4,773,348 | A | 9/1988 | Rowley |
| 4,783,303 | A | 11/1988 | Imgram |
| 4,793,375 | A | 12/1988 | Marty |
| 4,803,033 | A | 2/1989 | Rowley |
| 4,838,304 | A | 6/1989 | Knapp |
| 4,853,164 | A | 8/1989 | Kiang et al. |
| 4,877,660 | A | 10/1989 | Overbergh et al. |
| 4,887,642 | A | 12/1989 | Bernat |
| 4,942,644 | A | 7/1990 | Rowley |
| 4,957,135 | A | 9/1990 | Knapp |
| 4,971,112 | A | 11/1990 | Knapp |
| 4,979,530 | A | 12/1990 | Breda |
| 4,981,156 | A | 1/1991 | Nicklas et al. |
| 5,001,008 | A | 3/1991 | Tokita et al. |
| 5,006,207 | A | 4/1991 | Peterman et al. |
| 5,024,419 | A | 6/1991 | Mulvey |
| 5,027,851 | A | 7/1991 | Drees et al. |
| 5,053,097 | A | 10/1991 | Johansson et al. |
| 5,090,062 | A | 2/1992 | Hochstrasser |
| 5,095,554 | A | 3/1992 | Gloor |
| 5,100,565 | A | 3/1992 | Fujiwara et al. |
| 5,110,044 | A | 5/1992 | Bergmann |
| 5,127,814 | A | 7/1992 | Johnson et al. |
| 5,131,428 | A | 7/1992 | Bory |
| 5,148,837 | A | 9/1992 | Ågren et al. |
| 5,150,922 | A | 9/1992 | Nakashiba et al. |
| 5,174,324 | A | 12/1992 | Chrysler |
| 5,219,185 | A | 6/1993 | Oddenino |
| 5,279,333 | A | 1/1994 | Lawrence |
| 5,340,018 | A | 8/1994 | Macdonald et al. |
| 5,355,906 | A | 10/1994 | Marty et al. |
| 5,364,135 | A | 11/1994 | Anderson |
| 5,366,253 | A | 11/1994 | Nakashiba et al. |
| 5,375,889 | A | 12/1994 | Nakashiba et al. |
| 5,397,102 | A | 3/1995 | Kingman |
| 5,402,827 | A | 4/1995 | Gonzalez |
| 5,417,242 | A | 5/1995 | Goncze |
| 5,437,345 | A | 8/1995 | Schmidt et al. |
| 5,493,873 | A | 2/1996 | Donselman et al. |
| 5,494,259 | A | 2/1996 | Peterson |
| 5,518,027 | A | 5/1996 | Saiki et al. |
| 5,527,503 | A | 6/1996 | Rowley |
| 5,553,935 | A | 9/1996 | Burnham et al. |
| 5,555,912 | A | 9/1996 | Saadi et al. |
| 5,558,128 | A | 9/1996 | Pawelzik et al. |
| 5,566,707 | A | 10/1996 | Ching et al. |
| 5,573,037 | A | 11/1996 | Cole et al. |
| 5,577,393 | A | 11/1996 | Donselman et al. |
| 5,579,808 | A | 12/1996 | Mikol et al. |
| 5,582,438 | A | 12/1996 | Wilkins et al. |
| 5,586,746 | A | 12/1996 | Humpert et al. |
| 5,611,093 | A | 3/1997 | Barnum et al. |
| 5,615,709 | A | 4/1997 | Knapp |
| 5,622,210 | A | 4/1997 | Crisman et al. |
| 5,622,670 | A | 4/1997 | Rowley |
| 5,642,755 | A | 7/1997 | Mark et al. |
| 5,660,692 | A | 8/1997 | Nesburn et al. |
| 5,669,407 | A | 9/1997 | Bailey |
| 5,669,417 | A | 9/1997 | Lian-Jie |
| 5,669,595 | A | 9/1997 | Bytheway |
| 5,685,341 | A | 11/1997 | Chrysler et al. |
| 5,687,952 | A | 11/1997 | Arnold et al. |
| 5,692,536 | A | 12/1997 | Tokarz |
| 5,695,094 | A | 12/1997 | Burnham et al. |
| 5,725,008 | A | 3/1998 | Johnson |
| 5,725,010 | A | 3/1998 | Marty et al. |
| 5,730,173 | A | 3/1998 | Sponheimer |
| 5,741,458 | A | 4/1998 | Rowley |
| 5,746,244 | A | 5/1998 | Woolley, Sr. et al. |
| 5,756,023 | A | 5/1998 | Stachowiak |
| 5,758,690 | A | 6/1998 | Humpert et al. |
| 5,775,587 | A | 7/1998 | Davis |
| 5,803,120 | A | 9/1998 | Bertoli |
| 5,813,435 | A | 9/1998 | Knapp |
| 5,832,952 | A | 11/1998 | Cook et al. |
| 5,833,279 | A | 11/1998 | Rowley |
| 5,850,855 | A | 12/1998 | Kerschbaumer et al. |
| 5,857,489 | A | 1/1999 | Chang |
| 5,861,200 | A | 1/1999 | Rowley |
| 5,865,473 | A | 2/1999 | Semchuchk et al. |
| 5,875,809 | A | 3/1999 | Barrom |
| 5,893,387 | A | 4/1999 | Paterson et al. |
| 5,895,695 | A | 4/1999 | Rowley |
| 5,916,647 | A | 6/1999 | Weinstein |
| 5,924,451 | A | 7/1999 | Kuo |
| 5,927,333 | A | 7/1999 | Grassberger |
| 5,931,374 | A | 8/1999 | Knapp |
| 5,934,325 | A | 8/1999 | Brattoli et al. |
| 5,937,892 | A | 8/1999 | Meisner et al. |

(56) References Cited

U.S. PATENT DOCUMENTS

| | | | | |
|---|---|---|---|---|
| 5,944,225 | A | 8/1999 | Kawolics | |
| 5,950,663 | A | 9/1999 | Bloomfield | |
| 5,960,490 | A | 10/1999 | Pitsch | |
| 5,965,077 | A | 10/1999 | Rowley et al. | |
| 5,975,143 | A | 11/1999 | Järvenkylä et al. | |
| 5,979,489 | A | 11/1999 | Pitsch | |
| 6,013,382 | A | 1/2000 | Coltrinari et al. | |
| 6,023,796 | A | 2/2000 | Pitch | |
| 6,029,860 | A | 2/2000 | Donselman et al. | |
| 6,029,948 | A | 2/2000 | Shafer | |
| 6,044,859 | A | 4/2000 | Davis | |
| 6,053,214 | A | 4/2000 | Sjoberg et al. | |
| 6,062,251 | A | 5/2000 | Pitch | |
| 6,070,614 | A | 6/2000 | Holzheimer et al. | |
| 6,070,916 | A | 6/2000 | Rowley | |
| 6,073,972 | A | 6/2000 | Rivera | |
| 6,079,447 | A | 6/2000 | Holzheimer et al. | |
| 6,082,407 | A | 7/2000 | Paterson et al. | |
| 6,082,780 | A | 7/2000 | Rowley et al. | |
| 6,085,784 | A | 7/2000 | Bloom et al. | |
| 6,116,884 | A | 9/2000 | Rowley | |
| 6,123,232 | A | 9/2000 | Donselman et al. | |
| 6,131,600 | A | 10/2000 | Chang | |
| 6,138,296 | A | 10/2000 | Baker | |
| 6,155,297 | A | 12/2000 | MacAusland et al. | |
| 6,161,230 | A | 12/2000 | Pitsch | |
| 6,170,098 | B1 | 1/2001 | Pitsch | |
| 6,177,516 | B1 | 1/2001 | Hudak | |
| 6,202,686 | B1 | 3/2001 | Pitsch et al. | |
| 6,227,464 | B1 | 5/2001 | Allmendinger et al. | |
| 6,238,575 | B1 | 5/2001 | Patil | |
| 6,256,810 | B1 | 7/2001 | Baker | |
| 6,270,125 | B1 | 8/2001 | Rowley et al. | |
| 6,286,808 | B1 | 9/2001 | Slothower et al. | |
| 6,287,501 | B1 | 9/2001 | Rowley | |
| 6,293,336 | B1 | 9/2001 | Emerick, Sr. et al. | |
| 6,296,017 | B2 | 10/2001 | Kimizuka | |
| 6,305,407 | B1 | 10/2001 | Selby | |
| 6,315,715 | B1 | 11/2001 | Taylor et al. | |
| 6,328,059 | B1 | 12/2001 | Testori et al. | |
| 6,334,466 | B1 | 1/2002 | Jani et al. | |
| 6,341,617 | B1 | 1/2002 | Wilson | |
| 6,349,733 | B1 | 2/2002 | Smith | |
| 6,378,790 | B1 | 4/2002 | Paterson et al. | |
| 6,381,776 | B1 * | 5/2002 | Wang | 137/801 |
| 6,385,794 | B1 | 5/2002 | Miedzius et al. | |
| 6,439,581 | B1 | 8/2002 | Chang | |
| 6,462,167 | B1 | 10/2002 | Nodera et al. | |
| 6,464,266 | B1 | 10/2002 | O'Neill et al. | |
| 6,485,666 | B1 | 11/2002 | Rowley | |
| 6,517,006 | B1 | 2/2003 | Knapp | |
| 6,557,907 | B2 | 5/2003 | Rowley | |
| 6,609,732 | B1 | 8/2003 | Souvatzidis et al. | |
| 6,635,334 | B1 | 10/2003 | Jackson et al. | |
| 6,640,357 | B1 | 11/2003 | Chang | |
| 6,732,543 | B2 | 5/2004 | Jenkins, Jr. et al. | |
| 6,770,376 | B2 | 8/2004 | Chen | |
| 6,770,384 | B2 | 8/2004 | Chen | |
| 6,783,160 | B2 | 8/2004 | Rowley | |
| 6,803,133 | B2 | 10/2004 | Chen | |
| 6,817,379 | B2 | 11/2004 | Perla | |
| 6,835,777 | B2 | 12/2004 | Botros | |
| 6,838,041 | B2 | 1/2005 | Rowley | |
| 6,848,719 | B2 | 2/2005 | Rowley | |
| 6,860,523 | B2 | 3/2005 | O'Neill et al. | |
| 6,860,524 | B1 | 3/2005 | Rowley | |
| 6,877,172 | B2 | 4/2005 | Malek et al. | |
| 6,880,573 | B2 | 4/2005 | Berkman et al. | |
| 6,894,115 | B2 | 5/2005 | Botros | |
| 6,902,210 | B1 | 6/2005 | Rowley | |
| 6,920,899 | B2 | 7/2005 | Haenlein et al. | |
| 6,959,729 | B2 | 11/2005 | Graber | |
| 6,959,736 | B2 | 11/2005 | Järvenkylä | |
| 6,962,168 | B2 | 11/2005 | McDaniel et al. | |
| 6,978,795 | B2 | 12/2005 | Perrin | |
| 7,055,545 | B2 | 6/2006 | Mascari et al. | |
| 7,063,105 | B1 | 6/2006 | Chen | |
| 7,111,640 | B2 | 9/2006 | Rhodes | |
| 7,118,138 | B1 | 10/2006 | Rowley et al. | |
| 7,124,776 | B1 | 10/2006 | Hwang | |
| 7,134,452 | B2 | 11/2006 | Hiroshi et al. | |
| 7,140,390 | B2 | 11/2006 | Berkman et al. | |
| 7,225,828 | B2 | 6/2007 | Giagni et al. | |
| 7,231,936 | B2 | 6/2007 | Chang | |
| 7,406,980 | B2 | 8/2008 | Pinette | |
| 7,766,043 | B2 | 8/2010 | Thomas et al. | |
| 7,793,677 | B2 | 9/2010 | Pinette | |
| 7,828,013 | B2 * | 11/2010 | Lin | 137/801 |
| 8,240,326 | B2 * | 8/2012 | Kacik et al. | 137/315.12 |
| 2002/0100139 | A1 | 8/2002 | Rowley | |
| 2002/0100510 | A1 | 8/2002 | Otelli | |
| 2002/0167171 | A1 | 11/2002 | Becker et al. | |
| 2003/0183286 | A1 | 10/2003 | Yang | |
| 2004/0007278 | A1 | 1/2004 | Williams | |
| 2004/0021120 | A1 | 2/2004 | Turnau, III et al. | |
| 2004/0060608 | A1 | 4/2004 | Angus | |
| 2004/0117906 | A1 | 6/2004 | Baker et al. | |
| 2004/0150132 | A1 | 8/2004 | Rowley | |
| 2004/0176503 | A1 | 9/2004 | Czayka et al. | |
| 2005/0005989 | A1 | 1/2005 | Roloff | |
| 2005/0194051 | A1 | 9/2005 | Pinette | |
| 2006/0108705 | A1 | 5/2006 | Rowley | |
| 2006/0118185 | A1 | 6/2006 | Nobili | |
| 2006/0124183 | A1 | 6/2006 | Kuo | |
| 2006/0130908 | A1 | 6/2006 | Marty et al. | |
| 2006/0170134 | A1 | 8/2006 | Rowley et al. | |
| 2006/0174955 | A1 | 8/2006 | Huang | |
| 2006/0191580 | A1 | 8/2006 | Sponheimer et al. | |
| 2006/0200904 | A1 | 9/2006 | Vogel et al. | |
| 2006/0202142 | A1 | 9/2006 | Marty et al. | |
| 2007/0044852 | A1 | 3/2007 | Pinette | |
| 2007/0137714 | A1 | 6/2007 | Meehan et al. | |
| 2007/0137718 | A1 | 6/2007 | Rushlander et al. | |
| 2007/0271695 | A1 | 11/2007 | Thomas et al. | |
| 2009/0078322 | A1 | 3/2009 | Thomas et al. | |

FOREIGN PATENT DOCUMENTS

| | | |
|---|---|---|
| EP | 0 808 952 | 11/1997 |
| EP | 1 072 830 | 9/2004 |
| JP | 3094877 | 4/1991 |
| JP | 200132343 | 6/2001 |
| WO | WO 91/05191 | 4/1991 |
| WO | WO 00/61831 | 10/2000 |
| WO | WO 02/25022 | 3/2002 |
| WO | WO 2005/108829 | 11/2005 |
| WO | WO 2006/099273 | 9/2006 |
| WO | WO 2009/126887 | 10/2009 |
| WO | WO 2009/155529 | 12/2009 |
| WO | WO 2009/158498 | 12/2009 |

OTHER PUBLICATIONS

Dadex Polydex, 2005, 1 pg.

Dow, Plastic Pipes Europe, Middle East & Africa, Hot and Cold Water Pipes, 2007, 1 pg.

Dow, Plastic Pipes Europe, Middle East, & Africa, Dowlex PE-RT, 2007, 2 pgs.

Kerox, Ceramic Mixing Cartridge, Conventional Single-Lever Type, Model K-28, 2005, 2 pgs.

Kerox, Standard Cartridges, 2005, 3 pgs.

Noveon, Inc.; Processing with TempRite® PEX Ensures Quality Piping, www.tempritepex.com/processingInstallation/processing.asp, at least as early as Jun. 7, 2005, 2 pgs.

PEX Association, What is PE-X?, at least as early as Jan. 31, 2007, 7 pgs.

PPI Plastics Pipe Institute, Crosslinked Polyethylene (PEX) Tubing, TN-17/2001, www.plasticpipe.org/pdf/pubs/notes/tn17-01.pdf, Jun. 2001, 7 pgs.

(56) References Cited

OTHER PUBLICATIONS

SpecialChem S.A., Silane Crosslinking Agents Center, Crosslinking Mechanism, www.specialchem4polymers.com/tc/silane-crosslinking-agents/index.aspx?id=mechanism, at least as early as Jun. 7, 2005, 2 pgs.

Ticona Engineering Polymers, Engineering Polymers for Innovative Applications catalog, Mar. 2006, 16 pgs.

International Search Report and Written Opinion for PCT Application No. PCT/US2009/048657, issued Aug. 14, 2009, 14 pgs.

* cited by examiner

CENTERSET FAUCET WITH MOUNTABLE SPOUT

CROSS-REFERENCE TO RELATED APPLICATION

This application is a national phase filing of PCT International Application Serial No. PCT/US2009/048657, filed Jun. 25, 2009, which claims the benefit of U.S. Provisional Patent Application Ser. No. 61/133,030, filed Jun. 25, 2008, the disclosures of which are expressly incorporated herein by reference.

BACKGROUND AND SUMMARY OF THE INVENTION

The present invention relates to a faucet assembly and, more particularly, to a faucet assembly platform for supporting a non-metallic waterway.

Faucets are typically controlled by either a single handle which utilizes a mixing valve to proportion the flow of hot and cold water to a faucet spout, or two handles which utilize individual valves to separately control the flow of hot water and cold water to the faucet spout. In the case of the standard prior art mixing valve, two inlets are provided, one each for the hot and cold water supplies. For two handle faucets, each valve typically includes only one inlet opening which fluidly communicates with the flow passageway of a valving member. One type of two handle faucet is a centerset faucet where hot and cold water valves are coupled with the spout to a sink deck through a common base.

In an illustrative embodiment of the present disclosure, a faucet assembly includes an insert configured to receive a valve cartridge and including a guide member. A base includes a receiving member supporting the valve cartridge, the base being configured to cooperate with the guide member to resist axial movement of the insert relative to the base, and to resist rotational movement in a first direction of the insert relative to the base. A retainer is coupled to the base and is configured to cooperate with the guide member to resist rotational movement in a second direction opposite the first direction of the insert relative to the base.

According to a further illustrative embodiment of the present disclosure, a faucet assembly includes a base, a waterway supported by the base, and a valve assembly fluidly coupled to the waterway. An energy directing member is supported by one of the base and the waterway and is configured to embed within the other of the waterway and the base to form a seal therebetween.

According to another illustrative embodiment of the present disclosure, a faucet assembly includes a base, a waterway supported by the base and including a receiving port, and a valve assembly fluidly coupled to the waterway. A delivery spout is supported by the base, and a conduit is received within the delivery spout. The conduit includes a first end received within the receiving port and a collar supported proximate the first end. A seal is received within the receiving port and is compressed into sealing engagement with the waterway by the collar of the conduit.

In yet another illustrative embodiment of the present disclosure, a faucet assembly includes a base having a channel, and a waterway supported within the channel of the base. A valve assembly is fluidly coupled to the waterway. An insert is configured to cooperate with the base to secure the waterway to the base. A retainer is coupled to the base, and is configured to cooperate with the guide member to secure the insert to the base.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiment selected for description have been chosen to enable one skilled in the art to practice the invention.

Figure 1:
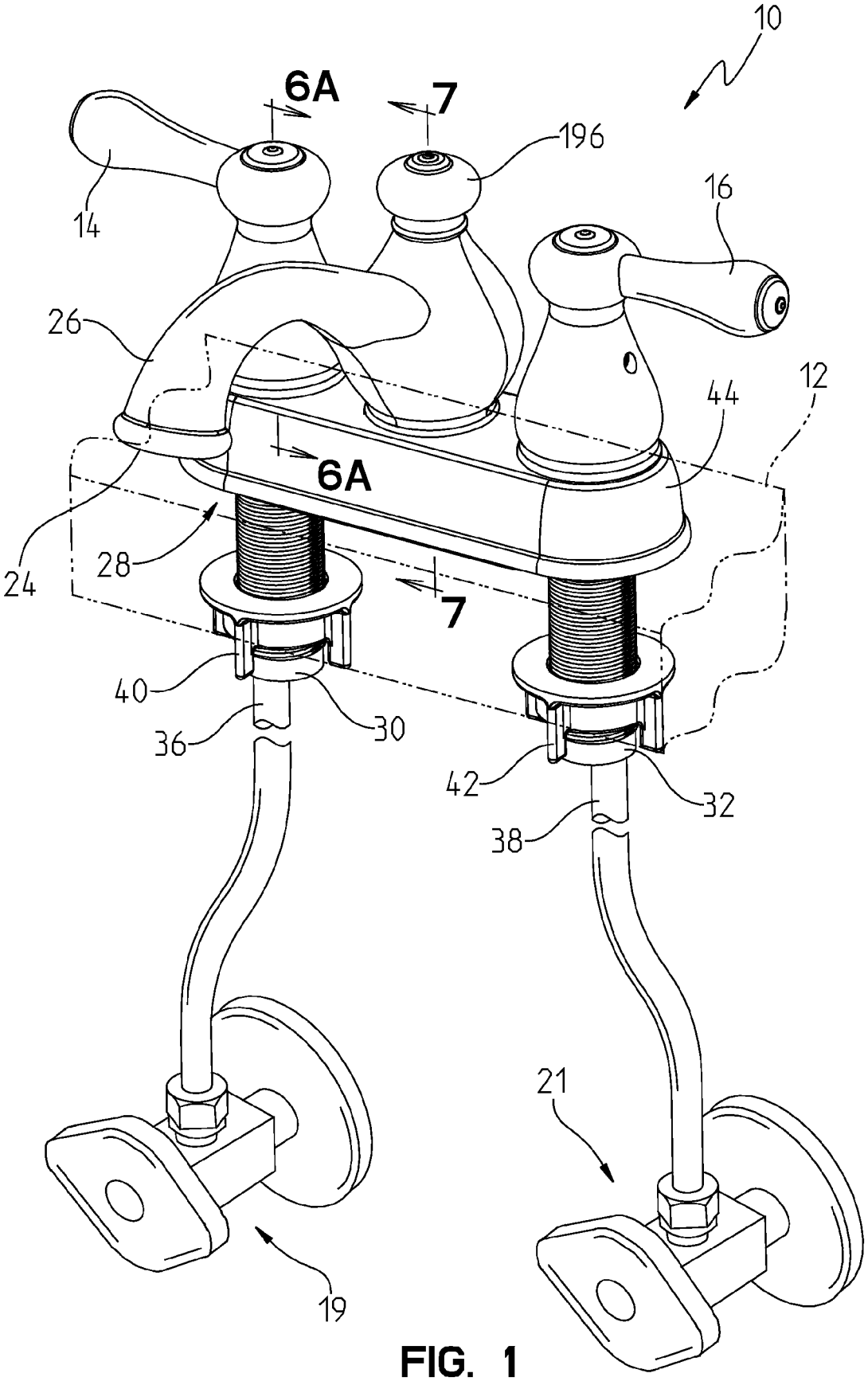
FIG. 1 is a perspective view of an illustrative faucet assembly.
Figure 2:
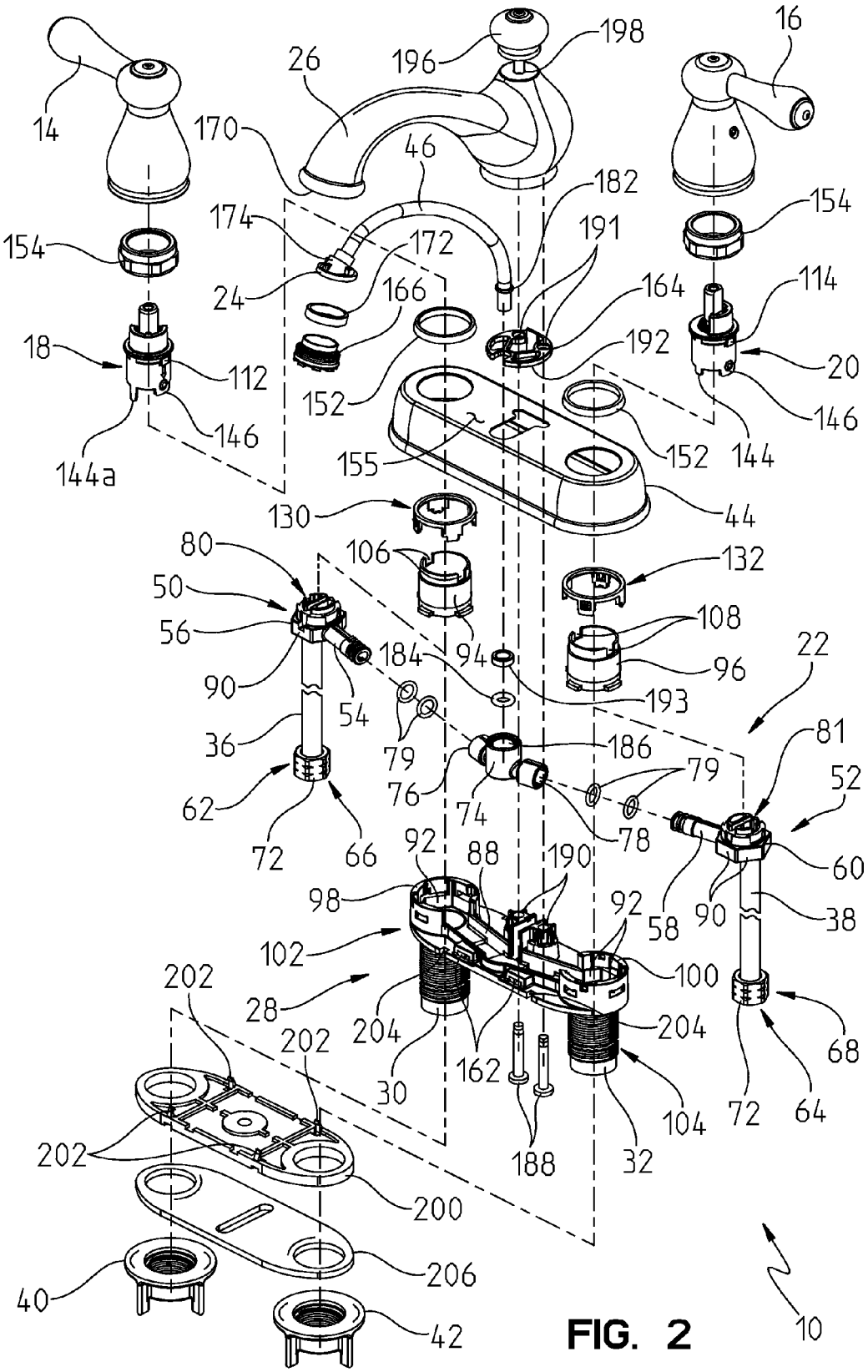
FIG. 2 is an exploded perspective view of the faucet assembly of FIG. 1.

Referring initially to FIGS. 1 and 2, an illustrative embodiment faucet assembly 10 is shown mounted to a mounting deck, illustratively a sink deck 12. The faucet assembly 10 includes hot and cold water handles 14 and 16 operably coupled to hot and cold water control valve cartridges 18 and 20, respectively. A waterway 22 fluidly couples the valve cartridges 18 and 20 upstream to hot and cold water supplies, illustratively valves or stops 19 and 21, and downstream to a mixed water outlet 24. The mixed water outlet 24 is illustratively supported by a delivery spout 26 formed of metal, such as a plated brass. In the illustrative embodiment, the valve cartridges 18 and 20 and cooperating handles 14 and 16, along with the delivery spout 26 are operably coupled to a common base 28 supported above the sink deck 12, thereby defining what is often referred to as a centerset faucet. As is known, rotation of the handles 14 and 16 operate the valve cartridges 18 and 20 to control the flow of hot and cold water, respectively, delivered to the outlet 24.

Figure 3:
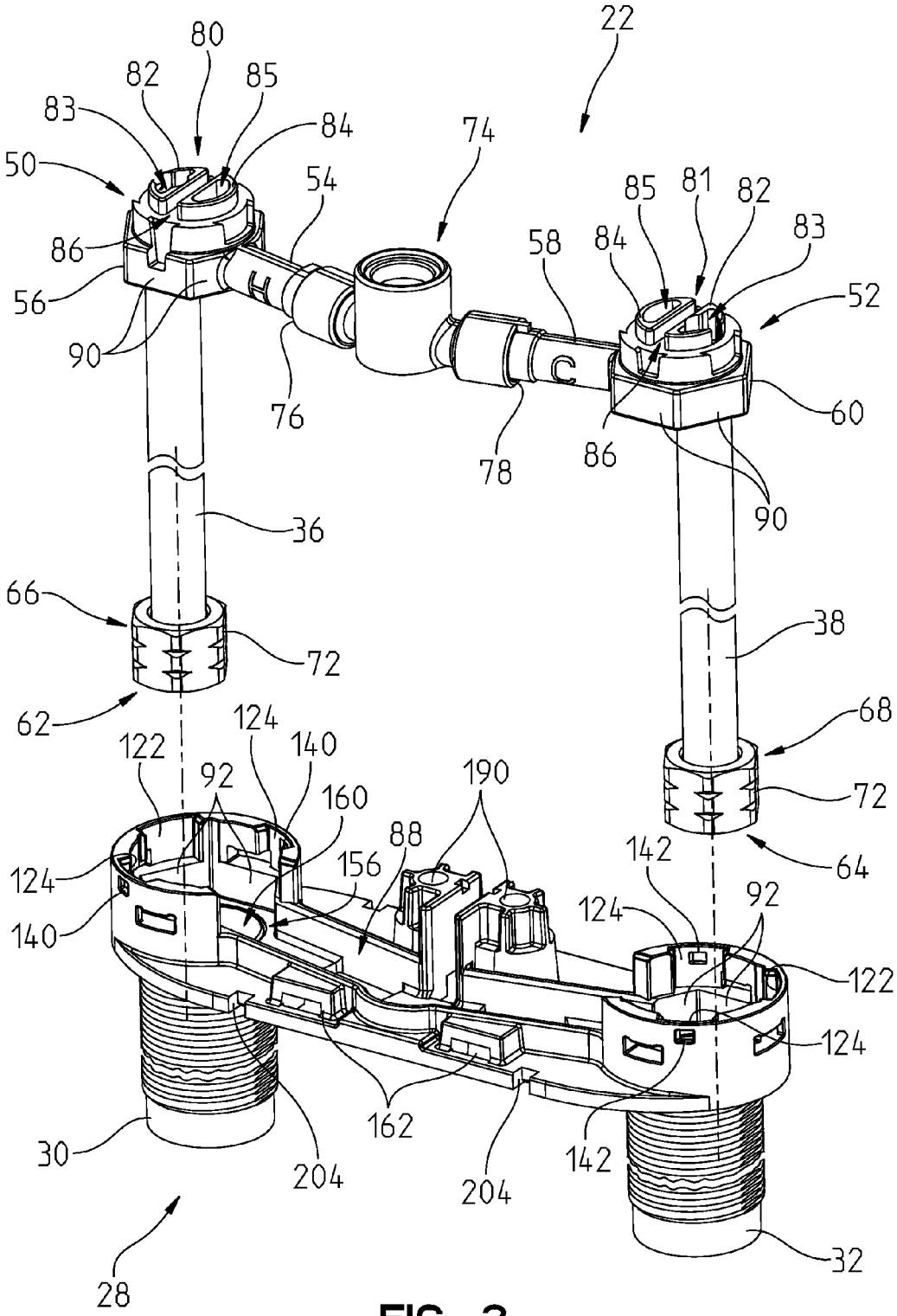
FIG. 3 is an exploded perspective view of the base and the waterway of the faucet of FIG. 2.

With reference to FIGS. 2 and 3, the waterway 22 is supported by the base 28 including first and second downwardly extending mounting members or shanks 30 and 32 which receive hot and cold water supply conduits or tubes 36 and 38, respectively. The hot and cold water supply tubes 36 and 38 may be fluidly coupled to the hot and cold water stops 19 and 21, respectively.

The base 28 is illustratively molded from a polymer. In one illustrative embodiment, the base 28 is molded from a glass filled polypropylene, such as Celstran® PP-GF 30-02, available from Ticona of Florence, Kent. Mounting nuts 40 and 42 are threadably received on the mounting shanks 30 and 32 to secure the base 28 to the sink deck 12. The mounting nuts 40 and 42 may be conventional wing nuts molded from a polymer. An escutcheon 44 is received over the base 28 and is illustratively formed of a metal, such as plated brass or zinc. The handles 14 and 16 and the delivery spout 26 are supported above the escutcheon 44. An outlet conduit 46 defines the mixed water outlet 24 and is illustratively received within the delivery spout 26. The outlet conduit 46 is fluidly coupled to the waterway 22.

The waterway 22 includes a hot water coupler 50 and a cold water coupler 52. The hot water coupler 50 includes the hot water supply tube 36 and a hot water outlet tube 54. A connector 56 fluidly couples the hot water supply tube 36 and the hot water outlet tube 54 through the hot water control valve cartridge 18. More particularly, the connector 56 fluidly couples the hot water supply tube 36 to the inlet of the valve cartridge 18, and fluidly couples the outlet of the valve cartridge 18 to the hot water outlet tube 54. Operation of the valve cartridge 18 controls the flow rate of hot water from supply tube 36 to outlet tube 54. In one illustrative embodiment, the hot water supply tube 36 and the hot water outlet tube 54 are formed of a polymer, such as polyethylene, and the connector 56 is an overmold formed of a polymer, such as polyethylene, molded around proximal ends of the tubes 36 and 54. The polyethylene of the connector 56 and the tubes 36 and 54 may be subsequently cross-linked to form cross-linked polyethylene (PEX). In a further illustrative embodiment, the hot water outlet tube 54 is simultaneously molded as part of the connector 56.

The cold water coupler 52 is substantially similar to the hot water coupler 50 as including the cold water supply tube 38 and a cold water outlet tube 58. A connector 60 fluidly couples the cold water supply tube 38 and the cold water outlet tube 58 through the cold water control valve cartridge 20. More particularly, the connector 60 fluidly couples the cold water supply tube 38 to the inlet of the valve cartridge 20, and fluidly couples the outlet of the valve cartridge 20 to the cold water outlet tube 58. Operation of the valve cartridge 20 controls the flow rate of cold water from supply tube 38 to outlet tube 58. Illustratively, the cold water supply tube 38 and the cold water outlet tube 58 are formed of a polymer, such as polyethylene, and the connector 60 is an overmold formed of a polymer, such as polyethylene, molded around the proximal ends of the tubes 38 and 58. The polyethylene of the connector 60 and the tubes 38 and 58 may be subsequently cross-linked to form cross-linked polyethylene (PEX). In a further illustrative embodiment, the cold water outlet tube 58 is simultaneously molded as part of the connector 60.

As further detailed herein, the couplers 50 and 52 illustratively include connectors 56 and 60 formed of a flowable material which are overmolded around proximal ends of supply tubes 36 and 38, respectively. While any suitable material may be used to form connectors 56 and 60, a polymer, including thermoplastics and thermosets, may be utilized in the illustrative embodiment. In one illustrative embodiment, the connectors 56 and 60 are each formed of polyethylene which has been overmolded around the proximal ends of the supply tubes 36 and 38 and subsequently cross-linked to form PEX. It should be noted that in certain illustrative embodiments, reinforcing members, such as glass fibers, may be provided within the polyethylene of the connectors 56 and 60.

Both waterway supply tubes 36 and 38 are flexible such that connecting distal ends 62 and 64 may be moved relative to opposing proximal ends coupled to the respective connectors 56 and 60. Illustratively, the tubes 36 and 38 are formed of a polymer, such as an olefin or a polyethylene. In one illustrative embodiment, the tubes 36 and 38 are formed of a polyethylene which has been cross-linked to form a cross-linked polyethylene (PEX). However, it should be appreciated that other suitable materials may be substituted therefor.

End fittings 66 and 68 are coupled to connecting ends 62 and 64, respectively, to facilitate coupling to conventional hot and cold water stops 19 and 21. Each end fitting 66, 68 illustratively includes a male adapter 70 and a coupling nut 72. In one illustrative embodiment, the end fittings 66 and 68 may be of the type detailed in U.S. patent application Ser. No. 12/233,839, filed Sep. 19, 2008, entitled "Overmolded Fitting Connection with Color Indication."

The hot water outlet tube 54 of coupler 50 and the cold water outlet tube 58 of coupler 52 are fluidly coupled to an outlet member 74. More particularly, the outlet member 74 includes receiving bores 76 and 78 fluidly coupled to the outlet tubes 54 and 58. O-rings 79 provide seals between the outlet tubes 54 and 58 and receiving bores 76 and 78, respectively, of the outlet member 74. As with the connectors 56 and 60, the outlet member 74 may be formed of a polymer, such as cross-linked polyethylene (PEX).

In further illustrative embodiments, the waterway 22 may be formed such that the hot water coupler 50, the cold water coupler 52, and the outlet member 74 are integral with each other. In one illustrative embodiment, the outlet member 74 may be overmolded around the outlet tubes 54 and 58. More particularly, the outlet member 74 may be formed of a polymer, illustratively polyethylene, which has been overmolded around the ends of the outlet tubes 54 and 58 prior to cross-linking. The assembly of couplers 50 and 52 and outlet member 74 are then subsequently cross-linked to form PEX. In another illustrative embodiment, the connectors 56 and 60 of couplers 50 and 52 and outlet member 74 may be concurrently formed by molding around proximal ends of tubes 36 and 38. The connectors 56 and 60 and outlet member 74 may be formed of a polymer, illustratively polyethylene, which has been overmolded around the proximal ends of tubes 36 and 38 and then subsequently cross-linked to form PEX. Additional details of such an illustrative waterway are disclosed in International Patent Application Serial No. PCT/US09/40207 filed Apr. 10, 2009, entitled "Molded Waterway for a Two Handle Faucet."

As noted above, the hot water valve cartridge 18 is fluidly coupled to the hot water supply conduit 36, while the cold water valve cartridge 20 is fluidly coupled to the cold water inlet conduit 38. More particularly, the hot water coupler or molded waterway 50 fluidly couples the hot water supply conduit 36 to the hot water valve cartridge 18 through an interface or base 80. Similarly, the cold water coupler or molded waterway 52 fluidly couples the cold water valve cartridge 20 to the cold water supply conduit 38 through an interface or base 81.

Figure 5:
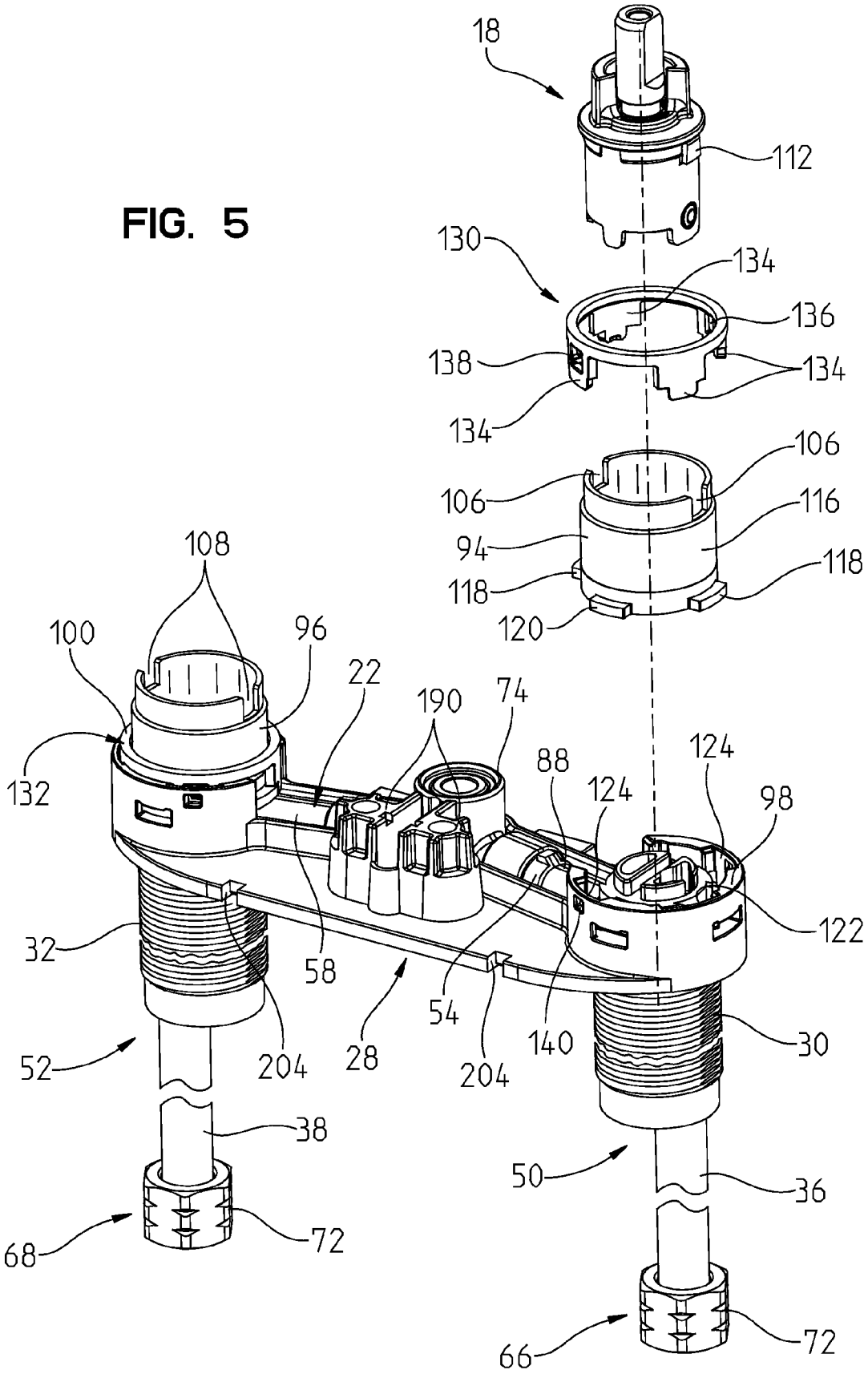
FIG. 5 is a rear exploded perspective view similar to FIG. 4.

With reference to FIG. 3, valve interfaces 80 and 81 each include an upwardly projecting inlet wall 82 extending around an inlet port 83, and an upwardly projecting outlet wall 84 extending around an outlet port 85. With respect to the valve interface 80, the inlet port 83 provides fluid communication between the hot water supply tube 36 and the inlet of the hot water valve cartridge 18, while the outlet port 85 provides fluid communication between the outlet of the hot water valve cartridge 18 and the hot water outlet tube 54. Likewise, in the valve interface 81, the inlet port 83 provides fluid communication between the cold water supply tube 38 and the inlet of the valve cartridge 20, while the outlet port 85 provides fluid communication between the outlet of the cold water cartridge 20 and the cold water outlet tube 58. The inlet and outlet walls 82 and 84 of each valve interface 80 and 81 define a seat, illustratively trench 86, for receiving a resilient gasket 87. The gasket 87 may be formed of an elastomer and provides a seal intermediate the respective valves 18 and 20 and bases 80 and 81 (FIG. 5A). While the supply tubes 36 and 38 are illustrated as having a circular cross-section, it should be noted that the cross-sectional shape of the supply tubes 36 and 38 within the couplers 50 and 52 may vary. For example, the cross-section of the supply tubes 36 and 38 may be oval or D-shaped in order to facilitate material flow during the molding operation for defining an increased and/or substantially consistent thickness of walls 82 and 84.

Operation of the hot water valve cartridge 18 by rotating handle 14 controls the flow of the hot water from the hot water supply conduit 36 through the connector 56 and the outlet tube 54 to the outlet member 74 which is coupled to the outlet conduit 46. Similarly, rotation of the cold water handle 16 controls operation of the cold water valve cartridge 20 to control the flow of cold water from the cold water supply conduit 38 to the connector 60 and the outlet tube 58 through the outlet member 74. The valve cartridges 18 and 20 may be of the type disclosed in further detail in U.S. Provisional Patent Application Ser. No. 61/132,664, filed Jun. 20, 2008, entitled "Valve Assembly For A Two Handle Faucet."

Figure 4:
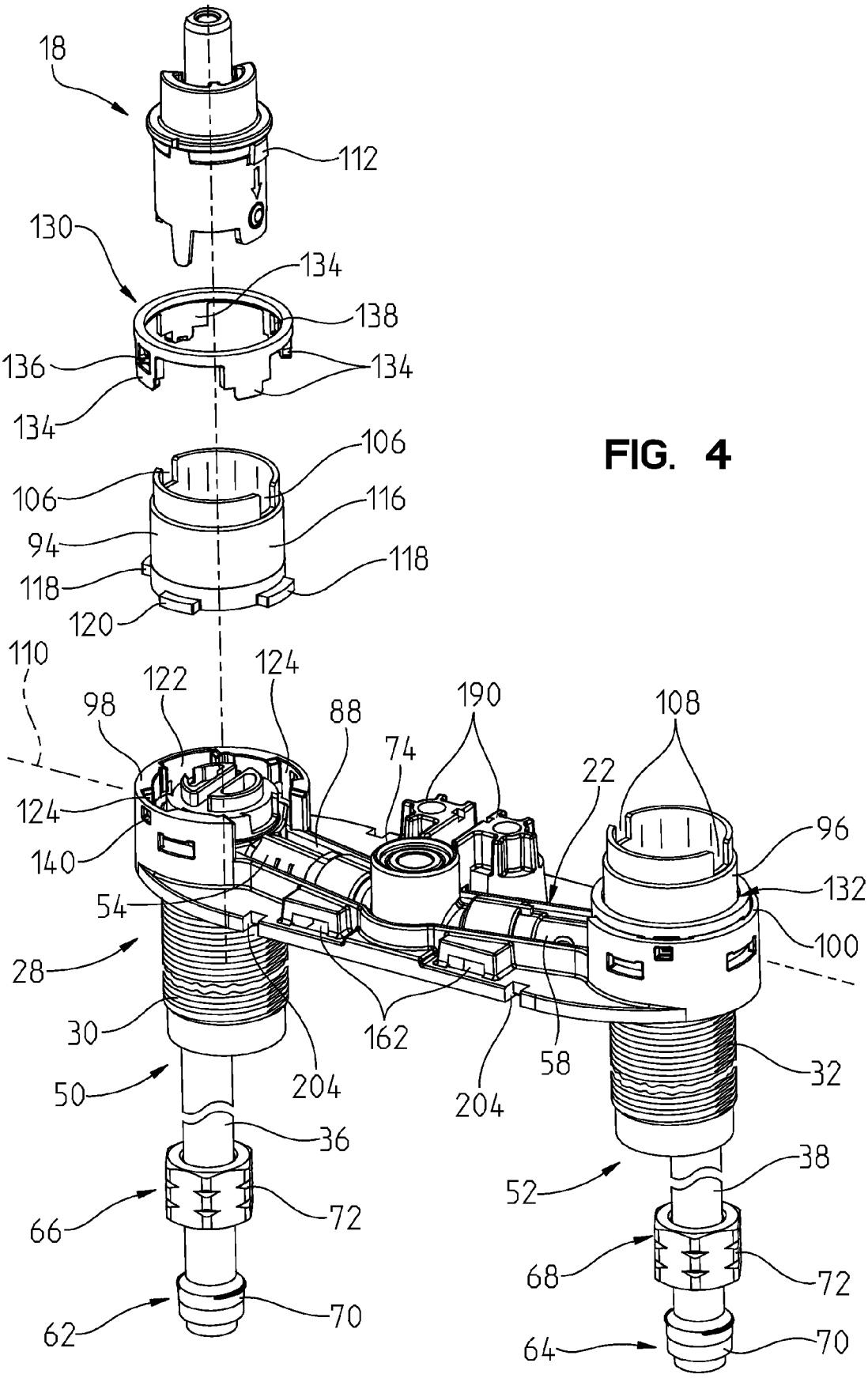
FIG. 4 is a front exploded perspective view of the base, the waterway, the insert, the retainer, and the valve cartridge of the faucet of FIG. 2.

The waterway 22 is coupled to the base 28 as shown in FIGS. 2-5. The base 28 illustratively includes a channel 88 for receiving the waterway 22. A plurality of flats 90 on the connectors 56 and 60 of the waterway 22 cooperate with flats 92 in the base 28 to thereby key the waterway 22 to the base 28. Inserts 94 and 96 are coupled to receiving members 98 and 100 at opposing ends 102 and 104 of the channel 88 of the base 28, thereby locking the waterway 22 to the base 28. Illustratively, the inserts 94 and 96 are formed of metal, such as brass, however other materials of suitable strength and durability may be substituted therefor. Diametrically opposed notches 106 and 108 may be formed in respective inserts 94 and 96 and are illustratively configured to substantially align with a center line or axis 110 of the base 28 (FIG. 4). The notches 106 and 108 are configured to receive cooperating, diametrically opposed tabs 112 and 114 of the valve cartridges 18 and 20, respectively, thereby rotationally orienting the cartridges 18 and 20 with respect to the base 28.

With reference to FIGS. 4, 5, and 8-11, the inserts 94 and 96 each illustratively include a cylindrical sidewall 116 and radially outwardly extending guide tabs or members 118 and 120. Guide members 118 have different circumferential widths than guide members 120, so as to facilitate assembly of the inserts 94 and 96 to the base 28 in the proper rotational orientation. More particularly, the guide members 118 and 120 of the inserts 94 and 96 are received within respective cooperating channels 122 and 124 formed within the base 28. The channels 122 and 124 each include an axial portion 126 and a circumferential portion 128.

Figure 8:
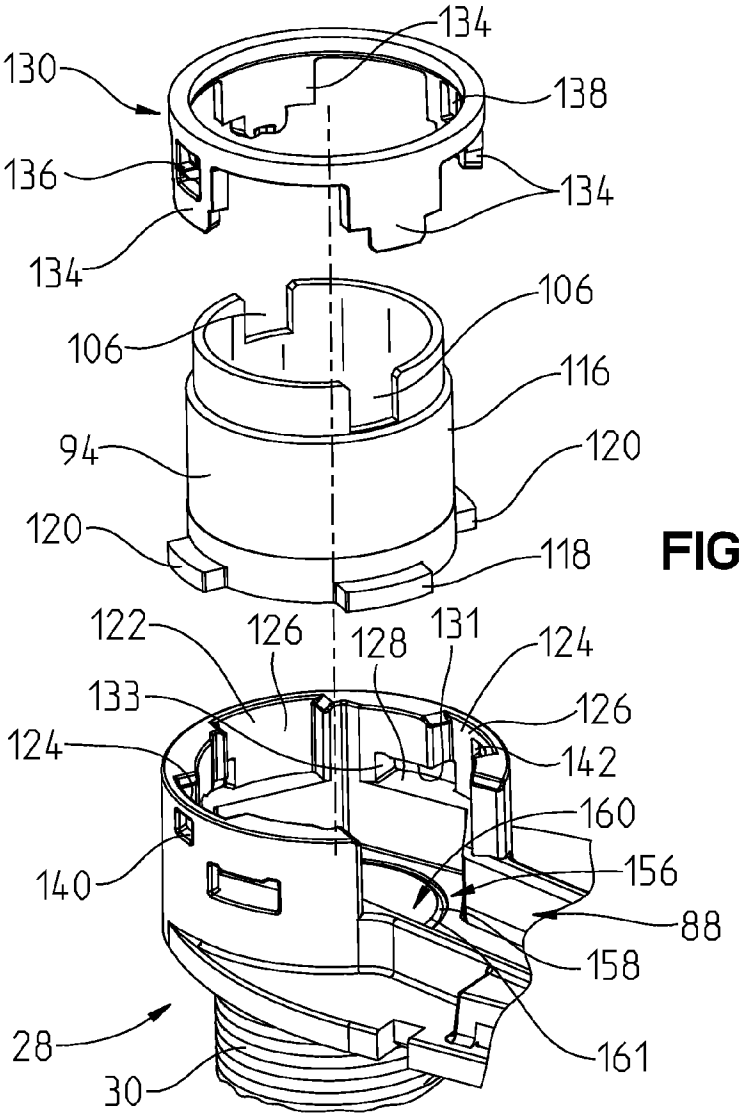

Successive illustrative steps of installing and securing the inserts 94 and 96 are shown in FIGS. 8-11, with the waterway 22 removed for clarity. While insert 94 is shown in FIGS. 8-11, it should be appreciated that insert 96 is substantially similar and cooperates with the base 28 in a similar manner After the waterway 22 is received within the channel 88 of base 28 (FIG. 3), the insert 94, 96 is axially moved toward the base 28 (in the direction of arrow 127 in FIG. 9), such that the guide members 118 and 120 are received within the axial portions 126 of channels 122 and 124. The insert 94, 96 is then rotated counterclockwise (in the direction of arrow 129 in FIG. 10) within the circumferential portions 128 of channels 122 and 124 in a bayonet style connection to provide axial resistance and rotational resistance in a first direction (counter-clockwise in FIGS. 8-11). In other words, the circumferential portions 128 of channels 122 and 124 axially secure the guide members 118 and 120, and also rotationally secure the guide members 118 and 120 in a first direction (away from the respective axial portions 126). More particularly, an upper wall 131 of circumferential portions 128 engage guide members 118, 120 to resist axial movement of the insert 94, 96 relative to the base 28. Similarly, an end wall 133 of circumferential portions 128 engage guide members 118, 120 to resist rotational movement in the first direction of the insert 94, 96 relative to the base 28 (FIG. 8).

Figure 11:
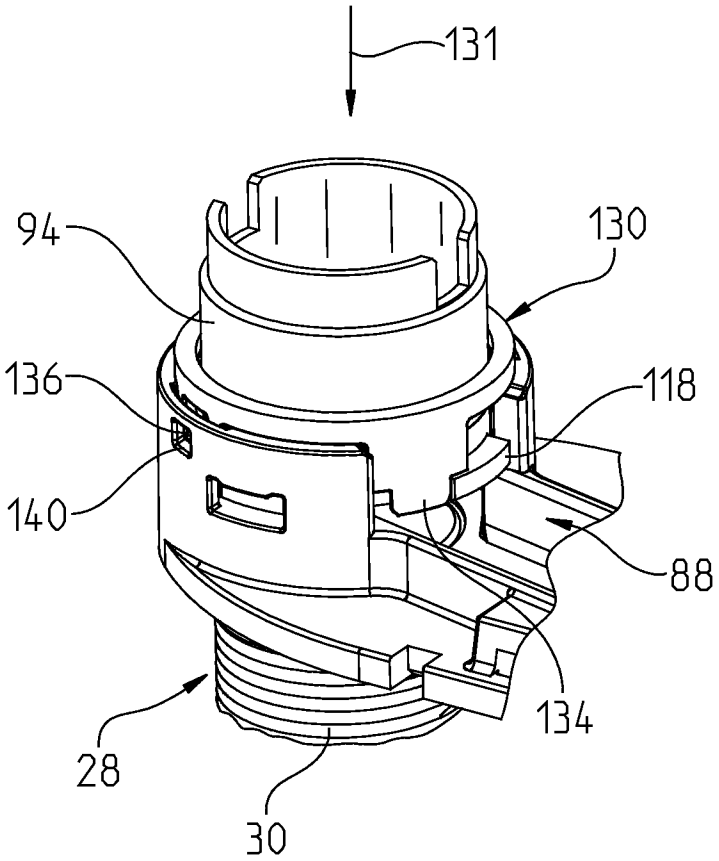
Figure 10:
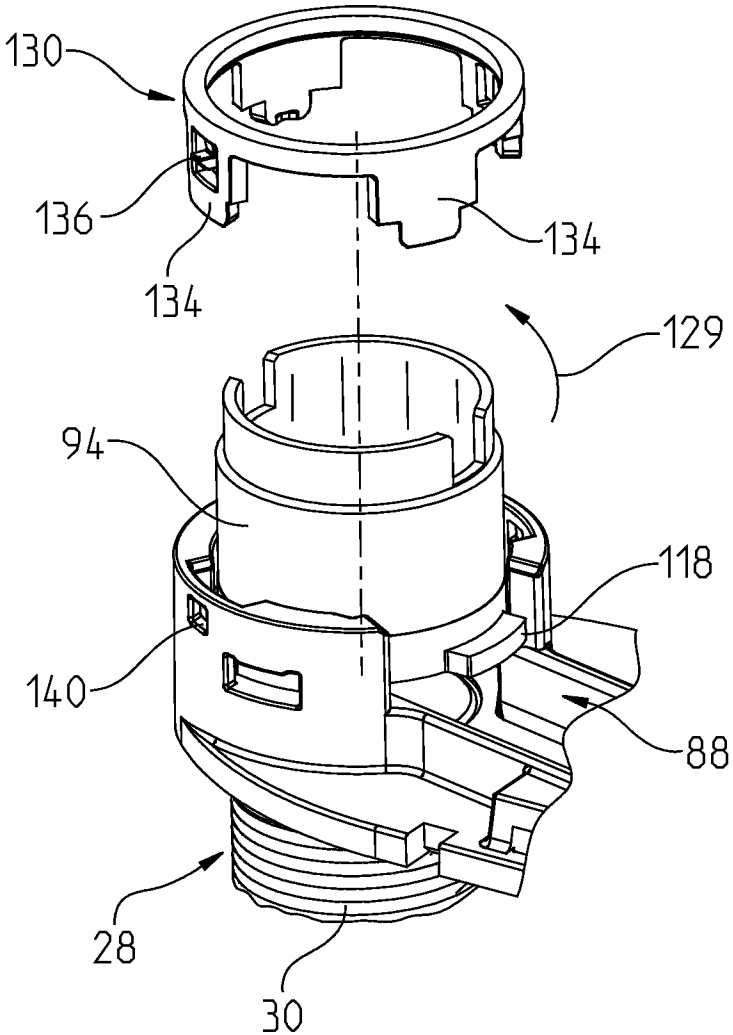

Retainers 130 and 132, illustratively clips or rings, each include a plurality of axially extending tabs 134 that are received within the axial portions 126 of channels 122 and 124. The tabs 134 provide rotational resistance to the insert 94, 96 in the remaining second direction (i.e., opposite the first direction and clockwise in FIGS. 8-11). More particularly, the tabs 134 engage guide members 118, 120 to resist rotational movement in the second direction of the insert 94, 96 relative to the base 28 (FIG. 11). As such, the inserts 94 and 96 and the retainers 130 and 132 cooperate to secure the waterway 22 to the base 28 (FIG. 3). The retainers 130 and 132 may be formed of a polymer, illustratively an acetal copolymer, for example Celcon® M90™, available from Ticona of Florence, Kent.

Figure 12:
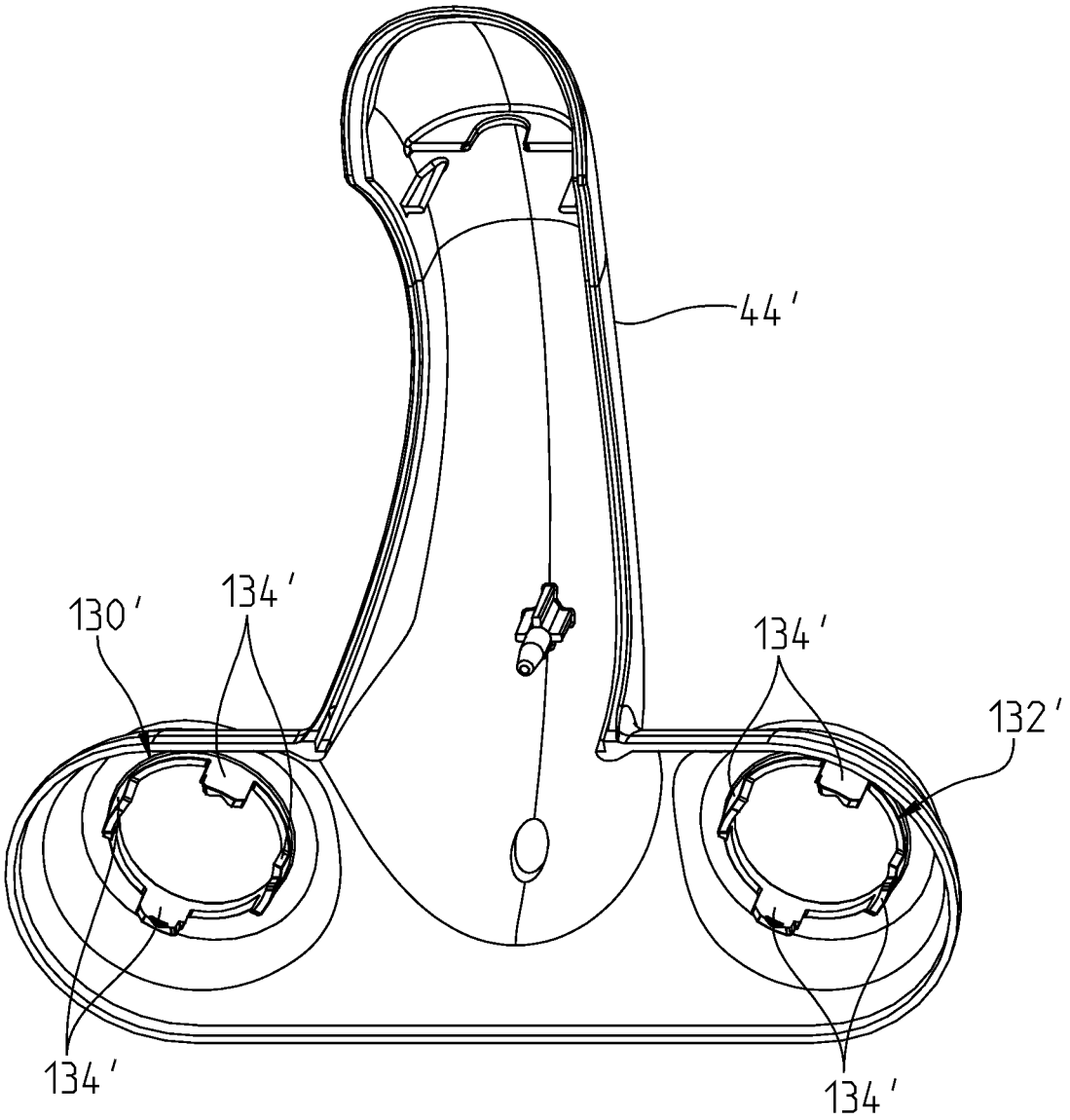
FIG. 12 is a bottom perspective view of an illustrative retainer supported by an escutcheon.

In the illustrative embodiment of FIG. 12, the retainers 130' and 132' are integrally formed as part of the escutcheon 44'. More particularly, the tabs 134' extend downwardly from a lower surface of the escutcheon 44'. The retainers 130' and 132' in such an embodiment are formed of the same material as the escutcheon 44', illustratively a metal, such as brass or zinc.

In the illustrative embodiment, snaps 136 and 138 on the retainers 130 and 132 engage within slots 140 and 142 on the base 28 for holding the inserts 94 and 96 in place and preventing the retaining rings 130 and 132 and the inserts 94 and 96 from becoming inadvertently dislodged (FIG. 11). The valve cartridges 18 and 20 assemble into receiving bores defined by the sidewalls 116 of the inserts 94 and 96, and align and key into the connectors 56 and 60 of the waterway 22 with diametrically opposed tabs 144 and 146 projecting from the respective valve cartridge 18, 20. One tab 144*a* may be longer than the other tabs 144 and 146 so that the cartridge 18, 20 will only assemble in a single rotational orientation within the respective connector 56, 60 (FIG. 2). Further, the tabs 144 and 146 may include ramped or angled side edges to cooperate with tapered recesses in the connectors 56 and 60 for centering potential misalignment between the valve cartridge 18, 20 and the respective connector 56, 60.

Escutcheon 44 is received over the base 28 and the waterway 22 and helps hold the retainers 130 and 132 in place. An annular spacer 152, illustratively a gasket which may be formed of a thermoplastic vulcanizate is received over each insert 94 and 96. In one illustrative embodiment, the spacer 152 is formed of Santoprene™ available from Exxon Mobile Chemical Company of Houston, Tex. A bonnet nut 154, illustratively formed of a metal such as brass, threadably receives an externally threaded upper end of each insert 94 and 96 to hold the valve cartridges 18 and 20 in place. The spacer 152 is illustratively received between the bonnet nut 154 and the escutcheon 44 for providing a downward load to the escutcheon 44 while sealing it from water that might drip onto an outer surface 155 of the escutcheon 44. Keys or tabs 112 and 114 in the cartridges 18 and 20 key into slots or notches 106 and 108 in the inserts 94 and 96 to provide rotational alignment and torque resistance to the cartridges 18 and 20.

Figure 6A:
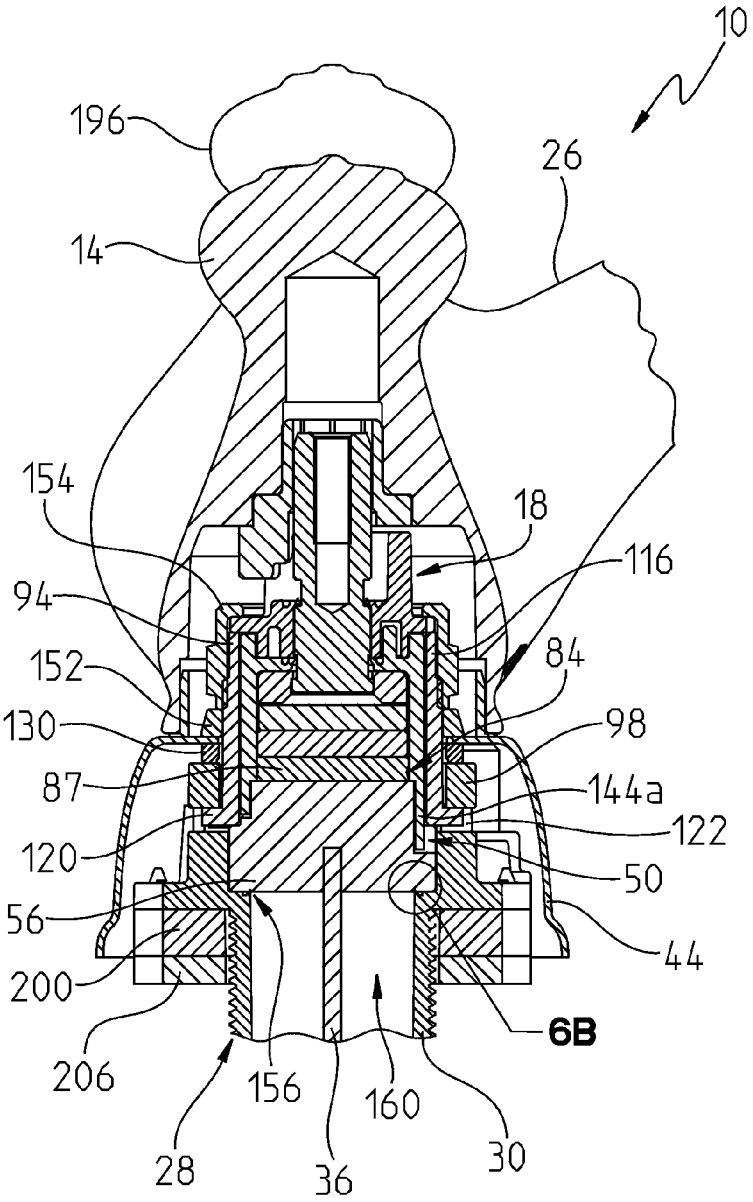
FIG. 6A is a cross-sectional view taken along line 6-6 of FIG. 1.
Figure 6B:
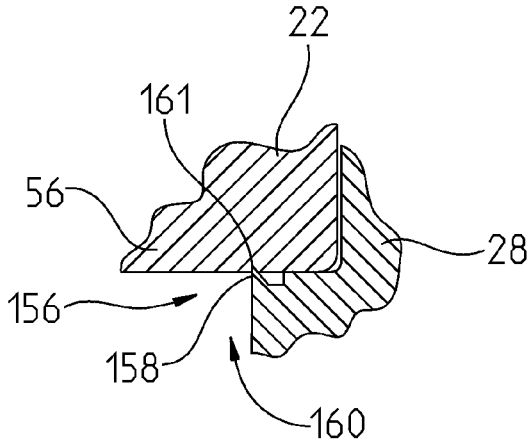
FIG. 6B is a detail cross-sectional view of FIG. 6A.

With reference to FIGS. 3, 6A, 6B, and 8, energy directors 156 are illustratively formed in the base 28 to provide a seal between the base 28 and the waterway 22. More particularly, the energy directors 156 illustratively include annular ridges 158 molded within the base 28 and surrounding the openings 160 extending through the mounting shanks 30 and 32 and receiving the supply conduits 36 and 38. The base 28 is illustratively formed of a material harder than that of the waterway 22 such that the energy director 156 will deform and embed into the waterway 22. Illustratively, the annular ridges 158 include a pointed or blade edge 161 to facilitate sealing with the connectors 56 and 60 of the waterway 22 (FIG. 6B). In the illustrative embodiment, the base 28 may be formed of a glass filled polymer, while the waterway 22 may be formed a cross-linked polyethylene (PEX) containing no glass fibers. Engagement of the energy directors 156 with the waterway 22 will force any water to the top of the base 28 where it can be directed to drip over the edge of the base 28 and under the escutcheon 44 rather than under the sink deck 12. Slots 162 are formed in the base 28 for use with alternative spout mounting arrangements. Moreover, the base 28 may be used with a variety of different styles and designs of escutcheons 44 and delivery spouts 26.

Figure 7:
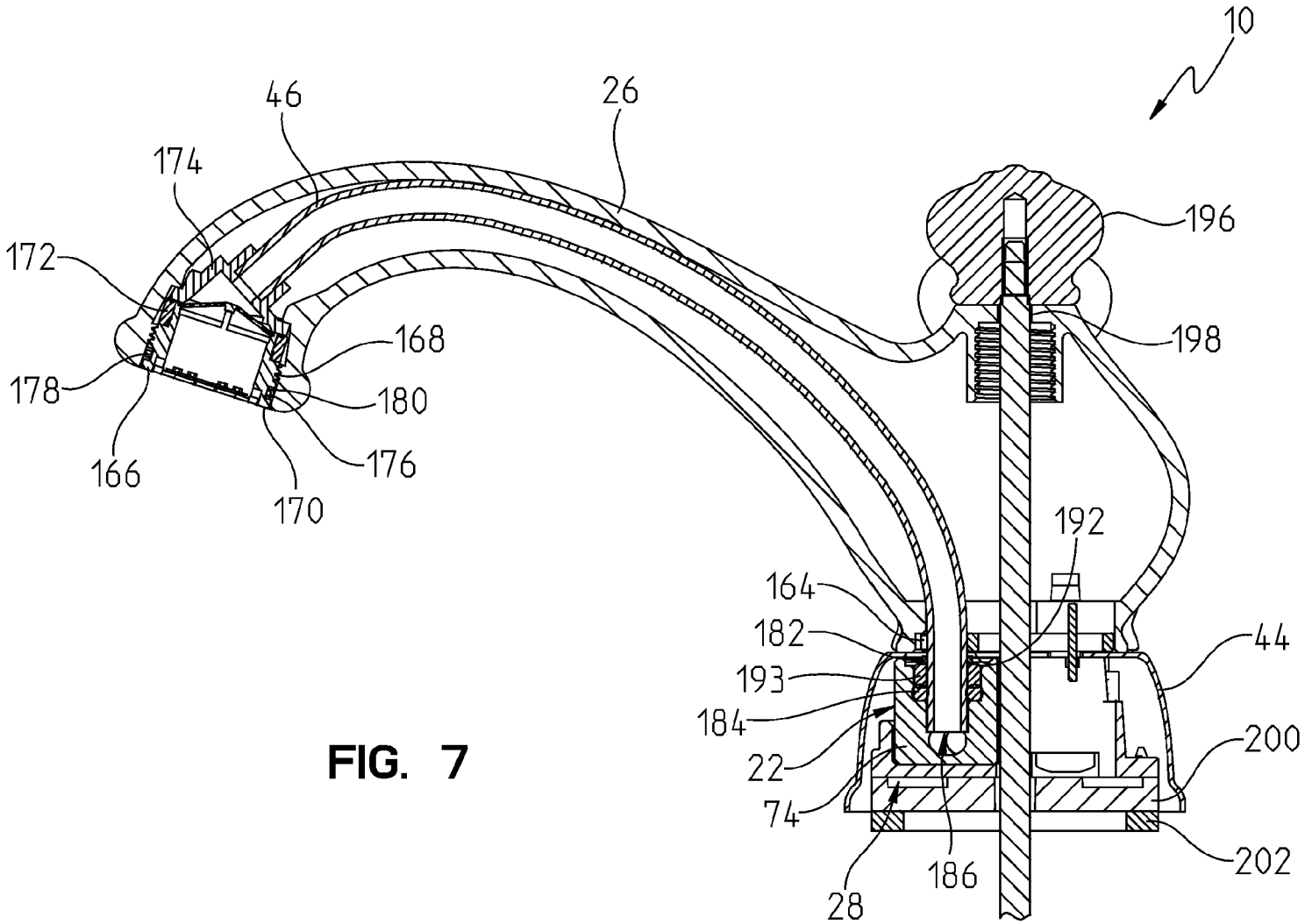
FIG. 7 is a cross-sectional view taken along line 7-7 of FIG. 1.
Figure 9:
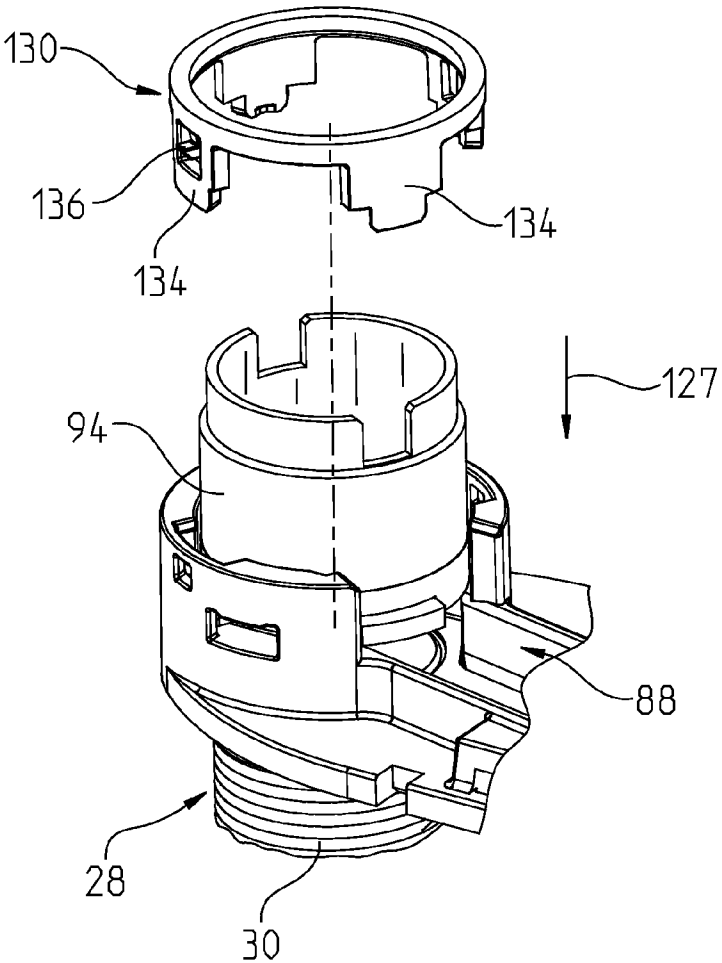
FIGS. 8-11 are perspective views showing successive steps of installing and locking the insert within the base by the retainer of FIG. 4, with the waterway removed for clarity.

With reference to FIGS. 2 and 7, the delivery spout 26 mounts above the escutcheon 44 through a mounting member 164. The mounting member 164 is illustratively formed of an acetal copolymer, for example Celcon® M90™. The outlet conduit 46 is received within the spout 26 and illustratively formed of a polymer, thereby providing a non-metallic waterway. An aerator 166 threads into threads 168 at the spout outlet 170 and forces a face seal, illustratively gasket 172, to seal between the aerator 166 and an adapter or flange 174 formed at the end of the outlet conduit 46. Illustratively, the flange 174 is a polymer overmold. In one illustrative embodiment, the outlet conduit 46 and the flange 174 may be formed of polyethylene which is cross-linked following the overmold operation, thereby forming cross-lined polyethylene (PEX). The outlet bore 176 of the spout 26 has an inner diameter large enough such that the aerator o-ring 178 does not seal against its inner surface 180 (FIG. 7). As such, should a leak develop, water will tend to go out the spout outlet bore 176 and not down the spout 26 toward the escutcheon 44 and below the sink deck 12.

With further reference to FIGS. 2 and 7, a shoulder 182 is illustratively supported by the inlet end of the outlet conduit 46 and forces an o-ring 184 into sealing engagement with a receiving bore 186 formed in the outlet member 74 of the waterway 22. The conduit 46 projects into the receiving bore 186, thereby providing support to the outlet conduit 46. The waterway 22 is thus fluidly coupled to the outlet conduit 46 and is sealed off at the o-ring 184. The spout 26 is coupled to the base 28 and retained thereto by the use of fasteners 188 extending through bosses 190 molded as part of the base 28 and through openings 191 formed within the mounting member 164. The bottom surface 192 of the mounting member 164 provides downward force to the shoulder 182 and a retainer ring 193, illustratively formed of polypropylene, to maintain a seal within the o-ring 184. Axial movement of the outlet conduit 46 is restrained by the mounting member 164.

More particularly, the outlet conduit 46 can only move upwardly away from the waterway 22 until the shoulder 182 molded on the conduit 46 contacts the bottom surface 192 of the mounting member 164.

A lift rod 196 illustratively assembles through a hole 198 in the spout 26 to provide access to a drain pop-up assembly (not shown). To facilitate manufacturing flexibility, the base 28 is formed as thin as possible. For faucets requiring taller escutcheons, a spacer 200, illustratively formed of polypropylene, is coupled to the base 28 to accommodate the difference in height. Illustratively, the spacer 200 includes a plurality of releasable retainers, such as snaps 202, configured to engage the base 28 within notches 204 (FIG. 2). A gasket 206, illustratively formed of a foam such as polyethylene, may be assembled onto the base 28 to provide a seal between the base 28 and the holes in the sink deck 12. As such, any potential leak or water collection will tend to flow underneath the edge of the escutcheon 44 as opposed to through the holes and below the sink deck 12.

Although the invention has been described in detail with reference to certain preferred embodiments, variations and modifications exist within the spirit and scope of the invention as described and defined in the following claims.

The invention claimed is:

1. A faucet assembly comprising:

an insert configured to receive a valve cartridge and including a radially outwardly extending guide member;

a base including a receiving member supporting the valve cartridge, the base including a channel including an axial portion and a circumferential portion, the circumferential portion configured to cooperate with the guide member to resist axial movement of the insert relative to the base, and to resist rotational movement in a first direction of the insert relative to the base; and a retainer coupled to the base and including an axially extending locking tab received within the axial portion of the channel, the locking tab extending into the circumferential portion to cooperate with the guide member to resist rotational movement in a second direction opposite the first direction of the insert relative to the base.

2. The faucet assembly of claim 1, wherein the insert is formed of a first material and the base is formed of a second material.

3. The faucet assembly of claim 2, wherein the insert is formed of a metal and the base is formed of a polymer.

4. The faucet assembly of claim 1, further comprising a waterway supported by the base and configured to fluidly couple the valve cartridge to a water supply, the insert securing the waterway to the base.

5. The faucet assembly of claim 4, further comprising an energy directing member supported by one of the base and the waterway and configured to embed within the other of the waterway and the base to form a seal therebetween.

6. The faucet assembly of claim 4, further comprising:

a delivery spout supported by the base;

a conduit received within the delivery spout and including an end, the conduit further including a collar supported proximate the end;

the waterway including a receiving port receiving the end of the conduit; and a seal received within the receiving port and compressed into sealing engagement with the base by the collar of the conduit.

7. The faucet assembly of claim 1, wherein the retainer includes an annular body supporting an axially extending locking tab.

8. The faucet assembly of claim 7, wherein the base includes a catch, and the retainer includes a snap to engage the catch on the base.

9. A faucet assembly comprising:

a base;

a waterway supported by the base;

a valve assembly fluidly coupled to the waterway; and an energy directing member supported by one of the base and the waterway and configured to embed within the other of the waterway and the base to form a seal therebetween.

10. The faucet assembly of claim 9, wherein the energy directing member comprises an annular lip formed within the base.

11. The faucet assembly of claim 10, wherein the base is formed of a material harder than the material of the waterway.

12. The faucet assembly of claim 11, wherein the base is formed of a glass-filled polymer and the waterway is formed of a polymer.

13. The faucet assembly of claim 9, wherein the waterway includes a water conduit extending through an opening formed in the base, and the energy directing member extends around the opening.

14. The faucet assembly of claim 13, wherein the base is configured to be positioned above a sink deck, and an escutcheon is supported above the base.

15. The faucet assembly of claim 9, further comprising:

a delivery spout supported by the base;

a conduit received within the delivery spout and including an end, the conduit further including a flange supported on the end;

an aerator coupled to an end of the delivery spout; and a face seal positioned intermediate the flange of the conduit and the aerator.

16. The faucet assembly of claim 9, further comprising:

a delivery spout supported by the base;

a conduit received within the delivery spout and including an end, the conduit further including a collar supported proximate the end;

the waterway including a receiving port receiving the end of the conduit; and a seal received within the receiving port and compressed into sealing engagement with the base by the collar of the conduit.

17. The faucet assembly of claim 9, further comprising:

an insert configured to receive a valve assembly and including a guide member;

a base including a receiving member supporting the valve assembly, the base configured to cooperate with the guide member to resist axial movement of the insert relative to the base, and to resist rotational movement in a first direction of the insert relative to the base; and a retainer coupled to the base and configured to cooperate with the guide member to resist rotational movement in a second direction opposite the first direction of the insert relative to the base.

18. A faucet assembly comprising:

a base;

a waterway supported by the base and including a receiving port;

a valve assembly fluidly coupled to the waterway;

a delivery spout supported by the base;

a conduit received within the delivery spout, the conduit including a first end received within the receiving port, and an outwardly extending collar supported proximate the first end;

a mounting member securing the delivery spout to the base; and a seal received within the receiving port, wherein the collar of the conduit is positioned intermediate the mounting member and the waterway.

19. The faucet assembly of claim 18, further comprising:

a flange supported on a second end of the conduit;

an aerator coupled to an end of the delivery spout; and a face seal positioned intermediate the flange of the conduit and the aerator.

20. The faucet assembly of claim 18, further comprising:

an insert configured to receive the valve assembly and including a guide member;

a base including a receiving member supporting the valve assembly, the base configured to cooperate with the guide member to resist axial movement of the insert relative to the base, and to resist rotational movement in a first direction of the insert relative to the base; and a retainer coupled to the base and configured to cooperate with the guide member to resist rotational movement in a second direction opposite the first direction of the insert relative to the base.

21. The faucet assembly of claim 18, further comprising an energy directing member supported by one of the base and the waterway and configured to embed within the other of the waterway and the base to form a seal therebetween.

22. A faucet assembly comprising:

a base including a channel;

a waterway supported within the channel of the base;

a valve assembly fluidly coupled to the waterway;

an insert configured to cooperate with the base to secure the waterway to the base, the insert including a guide member configured to resist axial movement of the insert relative to the base and to resist rotational movement in a first direction of the insert relative to the base; and a retainer coupled to the base and configured to cooperate with the guide member to secure the insert to the base, the retainer configured to cooperate with the guide member to resist rotational movement in a second direction opposite the first direction of the insert relative to the base.

23. The faucet assembly of claim 22, wherein the insert includes an annular body receiving the valve assembly.

24. The faucet assembly of claim 22, further comprising an energy directing member supported by one of the base and the waterway and configured to embed within the other of the waterway and the base to form a seal therebetween.

25. The faucet assembly of claim 22, further comprising:

a delivery spout supported by the base;

a conduit received within the delivery spout and including an end, the conduit further including a collar supported proximate the end;

the waterway including a receiving port receiving the end of the conduit; and a seal received within the receiving port and compressed into sealing engagement with the base by the collar of the conduit.

* * * * *